US009934887B2

(12) United States Patent
Deighton et al.

(10) Patent No.: US 9,934,887 B2
(45) Date of Patent: Apr. 3, 2018

(54) UMBILICAL

(75) Inventors: Alan William Deighton, Sunderland (GB); Siu Kit Joe Wong, Newcastle Upon Tyne (GB)

(73) Assignee: TECHNIP FRANCE (FR)

( * ) Notice: Subject to any disclaimer, the term of this patent is extended or adjusted under 35 U.S.C. 154(b) by 329 days.

(21) Appl. No.: 13/054,593

(22) PCT Filed: Jul. 23, 2009 (Under 37 CFR 1.47)

(86) PCT No.: PCT/GB2009/050907
§ 371 (c)(1), (2), (4) Date: Aug. 10, 2011

(87) PCT Pub. No.: WO2010/010396
PCT Pub. Date: Jan. 28, 2010

(65) Prior Publication Data

US 2012/0061123 A1 Mar. 15, 2012

(30) Foreign Application Priority Data

Jul. 25, 2008 (GB) ..... 0813877.8

(51) Int. Cl.
*H01B 5/08* (2006.01)
*H01B 7/04* (2006.01)
*H01B 1/02* (2006.01)

(52) U.S. Cl.
CPC ..... *H01B 7/045* (2013.01); *H01B 1/023* (2013.01)

(58) Field of Classification Search
USPC ..... 174/128.1
See application file for complete search history.

(56) References Cited

U.S. PATENT DOCUMENTS 3,647,939 A * 3/1972 Schoerner ..... 174/128.1
2009/0285634 A1* 11/2009 Smith ..... 405/156

FOREIGN PATENT DOCUMENTS

| | | | |
|---|---|---|---|
| DE | 661 604 | | 6/1938 |
| DE | 661604 | | 6/1938 |
| DE | 661604 | C * | 6/1938 |
| EP | 1 691 377 | | 8/2006 |
| EP | 1 691 377 | A2 | 8/2006 |
| EP | 1691377 | A2 * | 8/2006 |
| GB | 303919 | | 1/1929 |
| GB | 340261 | | 12/1930 |
| GB | 2 142 468 | | 1/1985 |

OTHER PUBLICATIONS

British Standards, "Aluminium and aluminium alloys-Chemical Composition and form of wrought products-", 2004, Part 1 and 3.*
(Continued)

*Primary Examiner* — Timothy Thompson
*Assistant Examiner* — Rhadames J Alonzo Miller
(74) *Attorney, Agent, or Firm* — Ostrolenk Faber LLP

(57) ABSTRACT

An umbilical for use in the offshore production of hydrocarbons comprising an assembly of functional elements at least one of which is an electrical power cable, characterised in that at least one conductor of at least one electrical power cable comprises one or more 6000 series aluminium strands.

11 Claims, 3 Drawing Sheets

(56) References Cited

OTHER PUBLICATIONS

Notification Concerning Transmittal of International Preliminary Report on Patentability dated Feb. 3, 2011 and Written Opinion of the International Searching Authority issued in corresponding International Application No. PCT/GB2009/050907.
Search Report issued in corresponding UK Patent Application No. 0813877.8 dated Aug. 25, 2008.
K.W. Barber et al., "Improved Overhead Line Conductors Using Aluminium Alloy 1120", Proceedings of the Power Engineering Society Transmission and Distribution Conference, vol. 10, pp. 528-534, XP000470574 (1994).

* cited by examiner

UMBILICAL

CROSS REFERENCE TO RELATED APPLICATIONS

The present application is a 35 U.S.C. § 371 National Phase conversion of PCT/GB2009/050907, filed Jul. 23, 2009, which claims benefit of British Application No. 0813877.8, filed Jul. 25, 2008, the disclosure of which is incorporated herein by reference. The PCT International Application was published in the English language.

BACKGROUND OF THE INVENTION

The present invention relates to an umbilical for use in the offshore production of hydrocarbons, and in particular to a power umbilical for use in deep water applications.

An umbilical consists of a group of one or more types of elongated active umbilical elements, such as electrical cables, optical fibre cables, steel pipes and/or hoses, cabled together for flexibility, over-sheathed and, when applicable, armoured for mechanical strength. Umbilicals are typically used for transmitting power, signals and fluids (for example for fluid injection, hydraulic power, gas release, etc.) to and from a subsea installation.

The umbilical cross-section is generally circular, the elongated elements being wound together either in a helical or in a S/Z pattern. In order to fill the interstitial voids between the various umbilical elements and obtain the desired configuration, filler components may be included within the voids.

ISO 13628-5 "Specification for Subsea Umbilicals" provides standards for the design and manufacture of such umbilicals.

Subsea umbilicals are installed at increasing water depths, commonly deeper than 1000 m. Such umbilicals have to be able to withstand severe loading conditions during their installation and their service life.

The main load bearing components in charge of withstanding the axial loads due to the weight and to the movements of the umbilical are steel pipes, steel rods, composite rods, or tensile armour layers.

The other elements, i.e. the electrical and optical cables, the thermoplastic hoses, the polymeric external sheath and the polymeric filler components, do not contribute significantly to the tensile strength of the umbilical.

Electrical cables used in subsea umbilicals fall into two distinct categories respectively known as signal cables and power cables.

Signal cables are used for transmitting signals and low power (<1 kW) subsea, such as to electrical devices on the seabed. Signal cables are generally rated at a voltage smaller than 3000V, and typically smaller than 1000V. Signal cables generally consist of small-section insulated conductors bundled together as pairs (2), quads (4) or, very rarely, any other number, the bundle then being over-sheathed.

Power cables are used for transmitting high electrical power (typically a few MW) subsea, such as to powerful subsea equipments such as pumps. Power cables are generally rated at a medium voltage comprised between 6 kV and 35 kV. A typical power cable is illustrated in the accompanying FIG. 1. Going from the inside layer to the outside layer, the power cable in FIG. 1 comprises a central copper conductor 2*a*, semi-conductor and electrical insulation layers 2*b*, a metallic foil screen 2*c*, and an external polymeric sheath 2*d*. The central conductor 2*a* generally has a stranded construction and a large cross-section, typically comprised between 50 $mm^2$ and 400 $mm^2$. Three phase power can be provided by three such cables bundled together within the umbilical structure.

An umbilical comprising at least one power cable is termed often a power umbilical. Thus, a power umbilical includes one or more electrical power cables, formed from one or more conductors, each conductor formed from one or more strands.

The conductors of these power cables within a subsea power umbilical are generally copper as specified in ISO 13628-5. They are not load bearing components because of the low yield strength and high specific gravity of copper. Moreover, these heavy copper conductors add considerable weight to an umbilical and have very poor load carrying capacity, thus limiting the sea depth that the umbilical can be deployed at. Unless protected, these electrical conductors may be damaged by excessive elongation or crushing, especially under severe conditions such as in deep water and/or dynamic umbilicals.

SUMMARY OF THE INVENTION

It is an object of the present invention to overcome one or more of the above problems and to provide a power umbilical which can be used in dynamic or deep water applications.

According to one aspect of the present invention, there is provided an umbilical for use in the offshore production of hydrocarbons comprising an assembly of functional elements at least one of which is an electrical power cable, characterised in that at least one conductor of at least one electrical power cable comprises one or more 6000 series aluminium strands.

6000 series aluminium comprises a series of wrought aluminium alloys alloyed with magnesium (Mg) and silicon (Si). They are defined in the European Standard EN 573-1 "Aluminium and aluminium alloys—Chemical composition and form of wrought products—Part 1: Numerical designation system". The four-digit numerical designation system specified in this European Standard is in accordance with the International Alloy Designation System (IADS) developed by the Aluminium Association, Arlington Va. 22209, USA. The first of the four digits in the EN 573/IADS designation system indicates the major alloying elements of the aluminium or aluminium alloy. When it is equal to 1, the corresponding material belongs to the "1000 series", and is almost pure wrought aluminium, i.e. comprising 99% or more aluminium. When it is equal to 6, the corresponding material is an aluminium alloy belonging to the "6000 series", and its major alloying elements are magnesium and silicon, which form an $Mg_2Si$ precipitate to give better mechanical properties after heat treatment.

6000 series aluminium strands can be formed from 6000 series aluminium using the same ways and methods as known conductor strand formation.

Thus, in the present invention, at least one conductor of at least one electrical power cable in the umbilical is an aluminium conductor where one or more conductor strands is from the aluminium 6000 series instead of being pure copper and being a pure copper conductor, such as the central copper conductor shown in the power cable of the accompanying FIG. 1. Such a conductor can then be similarly insulated to that shown in FIG. 1 with semi-conductor and electrical insulation layers 2*b*, a metallic foil screen 2*c* and an external polymeric sheath 2*d*.

The use of one or more aluminium 6000 series strands increases the tensile strength and stiffness of the electrical cable for deep water applications.

It is known that copper conductors have a very good electrical conductivity, which is the main reason why copper is obviously preferred to aluminium for power cable applications. However, the specific gravity of copper (around 8900 kg/m$^3$) is much higher than the specific gravity of aluminium (around 2700 kg/m$^3$), being a ratio of about 3.3. Furthermore, due to the Archimedes buoyant force, the relative weight difference between aluminium and copper is much more significant in water; the equivalent weight in water for aluminium is 1700 kg/m$^3$, and for copper 7900 kg/m$^3$, providing an increased ratio in water of about 4.65.

Thus, whilst the cross-sectional area of an aluminium conductor may be almost double that of an equivalent copper conductor for a given operating current and linear conductivity, the total weight in water of such an aluminium conductor (for the same operating current and linear conductivity) is only around 45% of the equivalent copper conductor. Given the fact that the power cable conductors are usually the heaviest components in an umbilical, replacing copper by aluminium makes it possible to reduce significantly the overall weight of the umbilical for the same operating current and linear conductivity.

Moreover, in deep water applications, copper cables would be overstressed under their own suspended weight, and would therefore have to be specially armoured with steel or composite wires. It has been calculated that the maximum water depth possible for a vertically suspended non-reinforced conductor is only around 775 m for standard annealed copper having a yield strength around 60 MPa. Around this limit, the tensile stress applied to the conductor at the topside point close to the surface reaches its yield strength.

In order to increase the water depth beyond this, and especially beyond 1000 and 2000 m depths, the skilled man would have to reinforce the copper conductor with steel or composite load carrying elements, or select harder alloyed copper grades, in order to improve the mechanical properties of the copper conductor. For the latter, quarter-hard copper having a yield strength around 190 MPa for example would assist the overstraining of the cable due to its own weight, but even harder copper materials are still brittle under these conditions, and for deep water applications, i.e. 2500 m and more, even high strength copper would have to be reinforced or armoured to avoid reaching the yield stress at the topside area. Furthermore, this improvement would not reduce the suspended weight of the power cable, which would remain the same or greater if (steel) armouring is used.

The wrought aluminium alloys belonging to the 6000 series have high mechanical properties (yield strength of around 200 MPa, and tensile strength higher than 250 MPa) and a good electrical conductivity, so that some of these materials are known for use as uninsulated overhead lines. Because of their low specific gravity and high tensile strength, conductors formed from these materials can withstand their suspended weight without any armouring in much deeper water depths than copper conductors.

Indeed, the calculated limit at which the tensile stress at the topside reaches the 200 MPa yield stress is around 12,000 m for the 6000 series aluminium materials, this being much higher than copper. As a consequence, 6000 series conductors can easily withstand their own suspended weight in water depths up to 4000 m without armouring, and their important load carrying capacity can be shared with the other components of the umbilical to reduce the load in said other components.

In one embodiment of the present invention, all the strands of at least one of the conductors of the electrical power cable(s) in the umbilical are 6000 series aluminium strands. Optionally, all the strands of all the conductors of at least one, optionally all of, the electrical power cable(s) in the umbilical are 6000 series aluminium strands.

Preferably, one, some or all the 6000 series aluminium strands are formed from one or more of the aluminium alloys designated 6101 or 6101-A or 6101-B, or one or more of the aluminium alloys designated 6201 or 6201-A; as defined in the "International Alloy Designations and Chemical Composition Limits for Wrought Aluminium and Wrought Aluminium Alloys" issued by the Aluminium Association, Arlington Va. 22209, USA. These materials are those of the 6000 series having the better electrical conductivity.

The 6101 and 6201 grades of 6000 series high tensile aluminium conductors can also be referred to as "AAAC" conductors—All Aluminium Alloy Conductors. There are also "AACSR" conductors—Aluminium Alloy Conductor Steel Reinforced—being 6201/6101 (series 6000)+steel grades. This standard terminology is defined in ASTM B354.

The AAAC conductors are manufactured from a heat treated, magnesium-silicon high strength aluminium alloy, and have become favoured conductors for overhead power lines. They have high electrical conductivity and contain enough magnesium silicide to give better mechanical properties after treatment. As well as their lower weight, there is no magnetic effect due to the steel core and therefore better AC resistance. Also there is no possibility of galvanic corrosion, which could occur between the aluminium and steel if using the above-mentioned AACSR conductors, or if using "ACSR" conductors—Aluminium Conductor Steel Reinforced, formed from standard 1350 aluminium from the 1000 series with steel reinforcement.

Such advantages increase the benefits of the umbilicals of the present invention.

6201 AAAC conductors have a temper designation of T81, whilst the 6101 AAAC conductors are either T81 or T83 designations. The 6201-T81 conductors are specified in ASTM B399 with their composition specified in B398. The 6101-T81 and 6101-T83 conductors are specified in CAN/CSA 610869. These international standards leave the exact chemical composition of the alloy to the manufacturer, but an alloy containing 0.6-0.9% magnesium and 0.5-0.9% silicon is specified in ASTM B398. There is a tight control set on all the other impurities, such as Cu, Fe, Mn, Zn, Cr, B, with a maximum allowable % so as not to greatly increase the electrical resistance.

In particular, the 6101, 6101-A and 6101-B grades comprise 0.3% -0.7% Si and 0.35%-0.9% Mg, in addition to 0.1% -0.5% Fe, 0.05% -0.1% Cu and small amounts of Mn, Cr Zn, and B impurities.

The 6201 and 6201-A grades comprise 0.5% -0.9% Si and 0.6%-0.9% Mg, in addition to 0.5% Fe, 0.04% -0.1% Cu and to small amounts of Mn, Cr, Zn and B impurities.

The 6201 and 6201-A aluminium alloys offer the better combination between mechanical, electrical and corrosion resistance properties, and are the best mode of the invention.

In a preferred embodiment, the 6000 series aluminium strand(s) have a yield strength higher than 200 MPa.

Preferably, the 6000 series aluminium strand(s) have an electrical resistivity smaller than 35 nΩ.m (nano-ohm metre). This corresponds to a nominal conductivity higher than 49.25% IACS (International Annealed Copper Standards).

In another embodiment of the present invention, at least one conductor of the electrical power cable(s) comprises one or more 6000 series aluminium strands and one or more 1000 series aluminium strands. Optionally, all the strands of all the conductors of the electrical power cable are a combination of 6000 series aluminium strands and 1000 series aluminium strands.

The umbilical of the present invention may include electrical power cable(s) able to provide 1-phase or 3-phase power.

The wrought 6000 series aluminium strand(s) are preferably tempered at the level T8 defined in the European Standard EN-515:1 "Aluminium and aluminium alloys—Wrought products—Temper designation". Such a process could involve the following process steps of solution heat treatment, cold working and then artificial ageing.

Example of Process:

1. Drawing an aluminium alloy rod of 9.5 mm diameter into the required size through a set of gradually size-reducing dies in a wire drawing machine.
2. Locating the material of step 1 into a furnace for heat treatment at a constant temperature at around 540° C.
3. After the heat treatment, dipping the heat treated alloy into cold water in a quenching tank. Its tensile strength is now about 150N/mm$^2$.
4. Drawing the material of step 3 into the required size in a wire drawing machine.
5. Subjecting the drawn wire to ageing at 160° C. temperature. Following drawing and ageing its tensile strength is raised to around 310N/mm$^2$.

The so-formed material has therefore derived its strength from two sources, the intermetallic compound $Mg_2Si$ and the cold work introduced by drawing.

The low temperature annealing has two effects:—

(a) artificial ageing causing precipitation of the $Mg_2Si$ particles and thus an increase in tensile strength with a reduction in electrical resistivity; and (b) partial annealing or recovery whereby the tensile strength is reduced and the ductility of the metal is significantly enhanced.

The net effect is to produce a ductile wire with low electrical resistivity and high tensile strength.

BRIEF DESCRIPTION OF THE DRAWINGS

Embodiments of the present invention will now be described, by way of example only, with reference to the accompanying drawings, in which:—

DESCRIPTION OF PREFERRED EMBODIMENTS

An umbilical in accordance with an embodiment of the present invention comprises an assembly of functional elements, such elements including steel pipes and/or thermoplastic hoses, optical fibre cables, reinforcing steel or carbon rods, electrical power cables, and electrical signal cables bundled together with filler material and over-sheathed by a polymeric external sheath.

Figure 1:
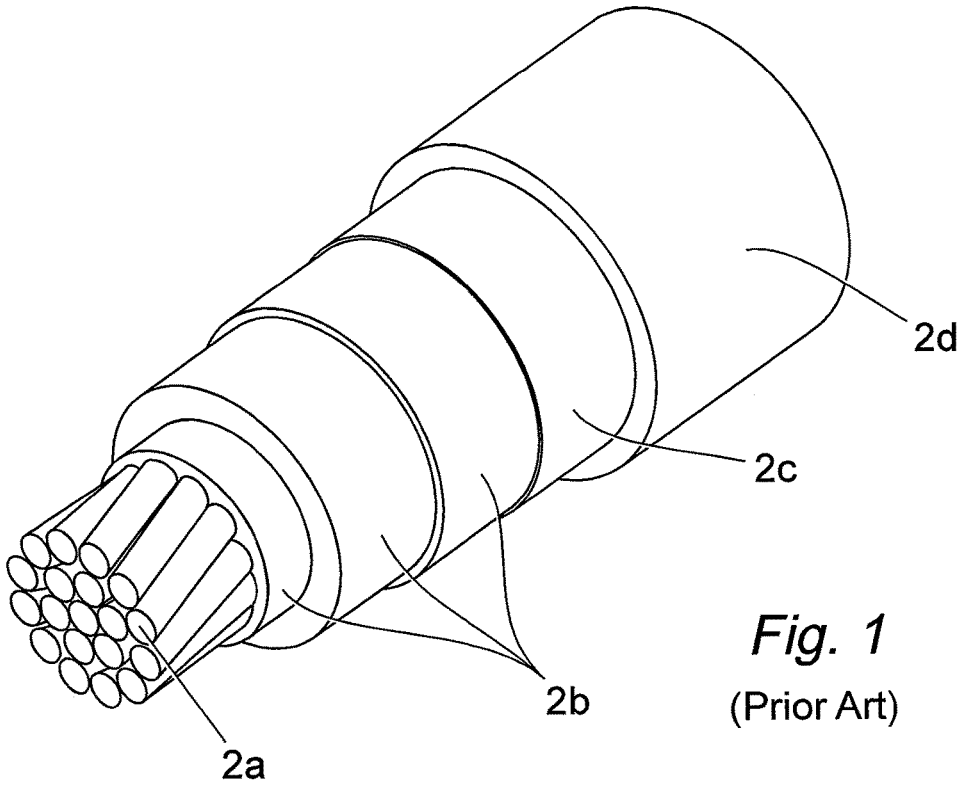
Fig. 1 (Prior Art)
FIG. 1 is a sectional view through a prior art power cable as described hereinabove.
Figure 2:
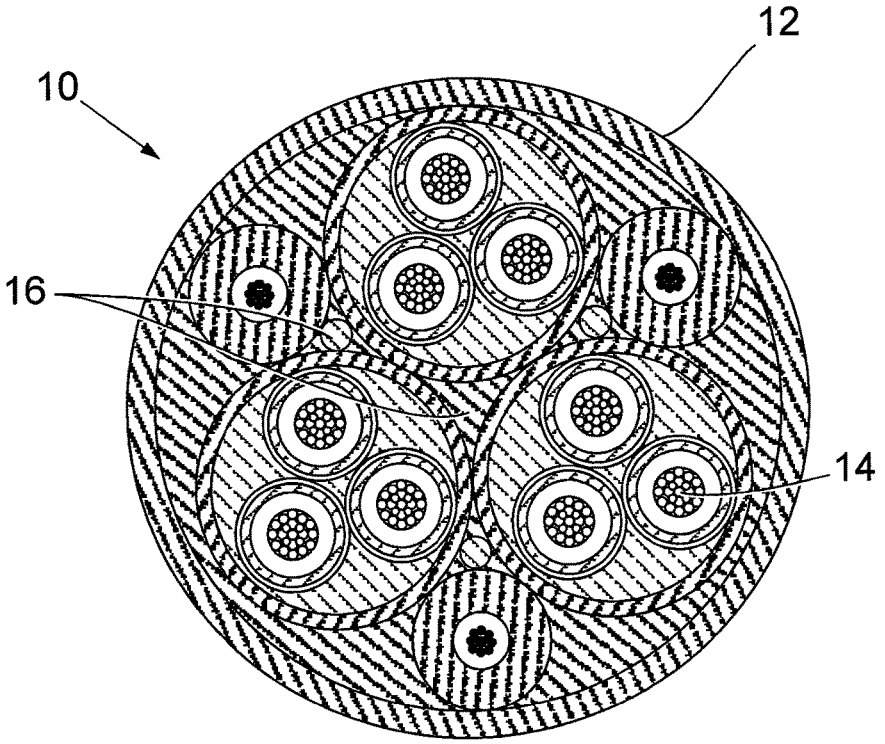
FIG. 2 is a sectional view through a first subsea umbilical (10) according to the present invention containing power cables (14), fillers (16), with an outer polymeric sheath (12)
Figure 3:
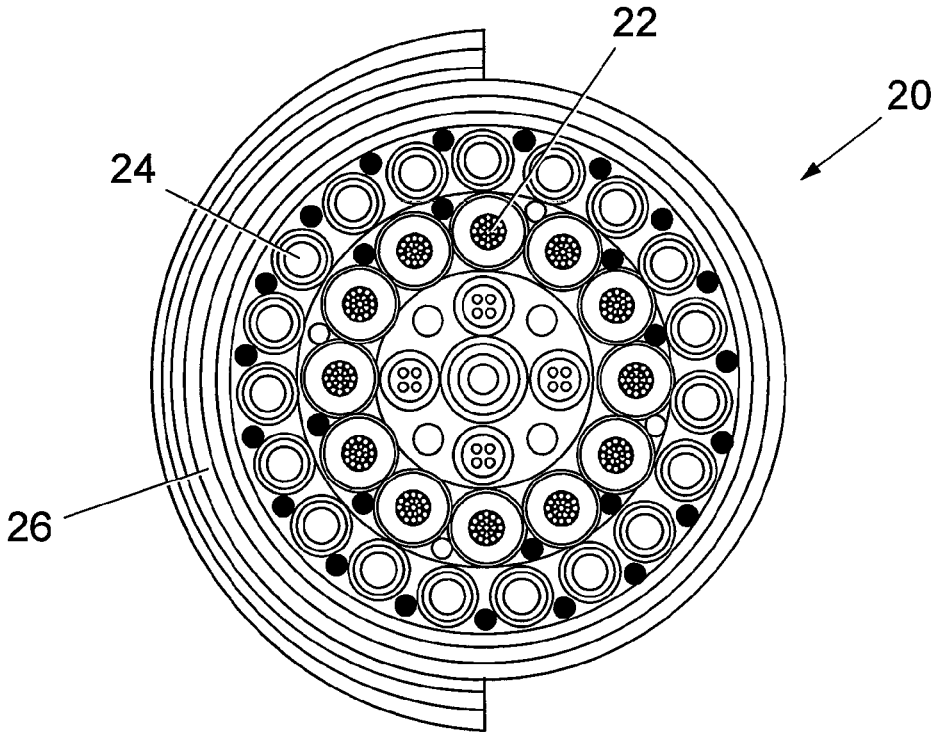
FIG. 3 is a sectional view through a second subsea umbilical (20) according to the present invention containing power cables (22), signal cables, optical fibre cables and thermoplastic hoses (24), and protected with steel wire armours (26)
Figure 4:
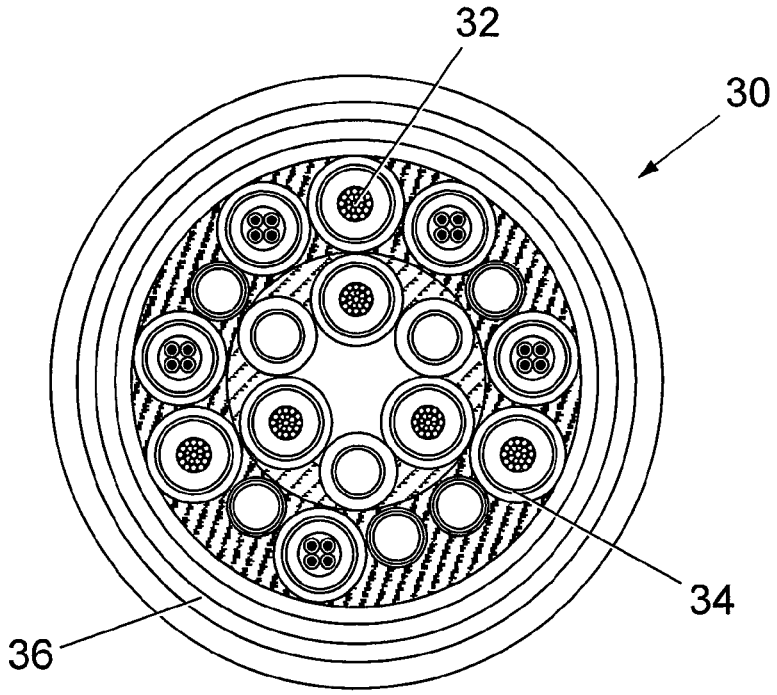
FIG. 4 is a sectional view through a third subsea umbilical (30) according to the present invention containing power cables (32), signal cables and steel tubes (34) and protected with steel wire armours (36)
Figure 5:
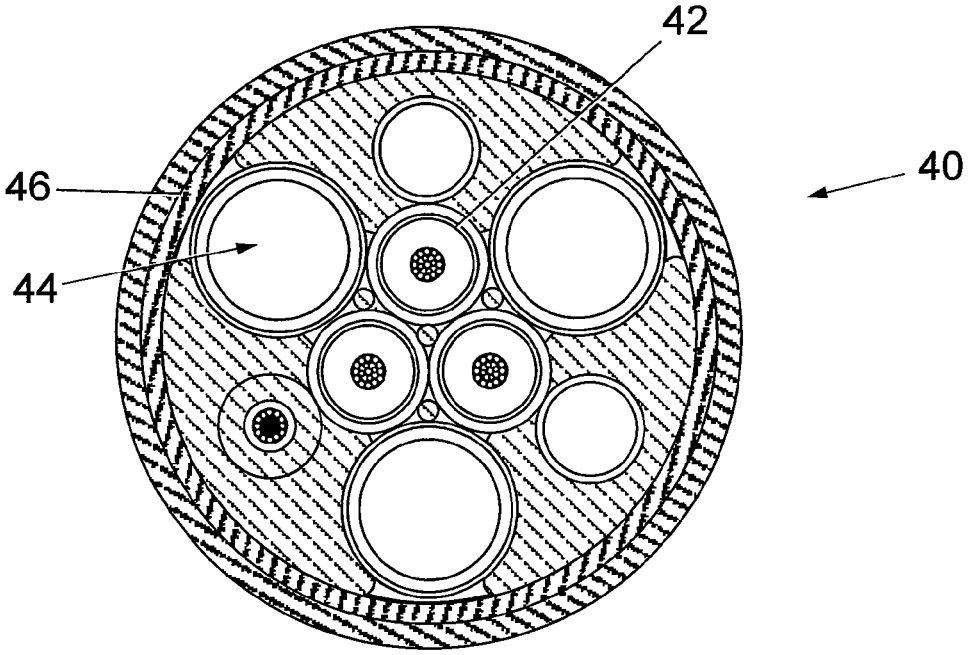
FIG. 5 is a sectional view through a fourth subsea umbilical (40) according to the present invention containing power cables (42), optical fibre cables and steel tubes (44), with an overall polymeric sheath (46)
Figure 6:
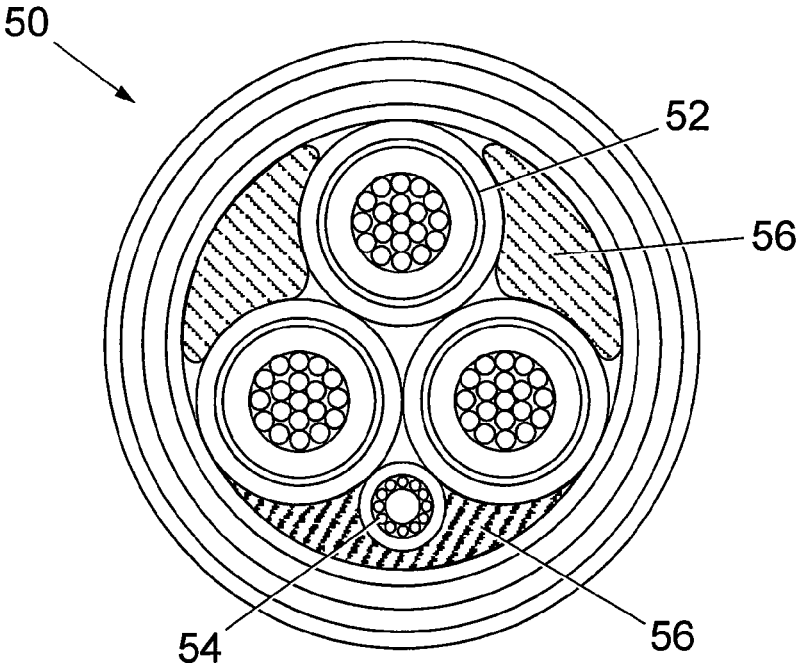
FIG. 6 is a sectional view through a fifth subsea umbilical (50) according to the present invention containing power cables (52), an optical fibre cable (54), fillers (56), and protected with steel wire armours.

Examples of various assembly arrangements according to the present invention are shown in FIGS. 2-6. Each of these embodiments includes at least one electrical power cable, generally in a symmetrical arrangement, and at least one conductor of one of the electrical power cables comprises one or more 600 series aluminium conductor strands as herein described. The strand(s) may be formed as described hereinabove.

The present invention applies to individual power conductors and to bundled power conductors (such as a trefoil bundle for a 3-phase power supply).

The power umbilicals and power cables according to the present invention can also be used to transfer the electrical energy generated by offshore windmills from said windmills to an onshore terminal.

The 6000 series aluminium strands can also be used in or as a signal cable conductor(s).

Various modifications and variations to the described embodiments of the invention will be apparent to those skilled in the art without departing from the scope of the invention as defined herein or in the appended claims. Although the invention has been described in connection with specific embodiments, it should be understood that the invention as claimed should not be unduly limited to such specific embodiments.

What is claimed is:

1. An umbilical for use in the offshore production of hydrocarbons comprising an assembly of functional elements at least one of which is an electrical power cable with a voltage rating of 6 kV or higher, wherein the electrical power cable comprises one or more strands of 6000 series aluminium, each strand having a cross-section selected to provide said strand with an operating current and linear conductivity that is the same as a copper strand with a cross-section, wherein said 6000 series aluminum comprises aluminum, silicon, and magnesium, wherein said 6000 series aluminium further comprises $Mg_2Si$ precipitates, wherein the cross-section of said strand is larger than the cross-section of said copper strand but said strand weighs less than said copper strand, wherein the strands of 6000 series aluminium have a yield strength higher than 200 MPa.

2. An umbilical as claimed in claim 1, wherein all the strands of at least one of the conductors are comprised of 6000 series aluminium.

3. An umbilical as claimed in claim 1, wherein one, some or all of the strands of 6000 series aluminium are formed from one or more of aluminium alloys comprising at least 0.3-0.7% silicon, 0.35-0.9% magnesium, 0.1-0.5% iron, and 0.05%-0.1% copper.

4. An umbilical as claimed in claim 1, wherein one, some or all of the strands of 6000 series aluminium are formed from one or more of aluminium alloys comprising 0.5-0.9% silicon, 0.6-0.9% magnesium, 0.04-0.1% copper.

5. An umbilical as claimed in claim 1, wherein the strands of 6000 series aluminium have an electrical resistivity smaller than 35 nΩ.m (nano-ohm meter).

6. An umbilical as claimed in claim 1, wherein all the strands of all the conductors of the electrical power cable are comprised of 6000 series aluminium.

7. An umbilical as claimed in claim 1, wherein at least one conductor comprises one or more strands of 6000 series aluminium and one or more strands of 1000 series aluminium alloy, which comprises at least 99%.

8. An umbilical as claimed in claim 7, wherein all the strands of all the conductors of the electrical power cable are a combination of strands of 6000 series aluminium and strands of 1000 series aluminium.

9. An umbilical as claimed in claim 1, wherein the electrical power cable is able to provide 1-phase or 3-phase power.

10. An umbilical as claimed in claim 1, wherein the power cable is rated for 6 kV or more and is capable of transmitting 1 MW of power or more.

11. An umbilical as claimed in claim 1, wherein each strand is coldworked and aged.

* * * * *